US009631417B2

(12) United States Patent
Massey

(10) Patent No.: US 9,631,417 B2
(45) Date of Patent: Apr. 25, 2017

(54) SCREEN CORNER ATTACHMENT

(71) Applicant: Milgard Manufacturing Incorporated, Taylor, MI (US)

(72) Inventor: Victor Massey, Orting, WA (US)

(73) Assignee: MILGARD MANUFACTURING INCORPORATED, Tacoma, WA (US)

( * ) Notice: Subject to any disclaimer, the term of this patent is extended or adjusted under 35 U.S.C. 154(b) by 419 days.

(21) Appl. No.: 13/724,687

(22) Filed: Dec. 21, 2012

(65) Prior Publication Data

US 2014/0174021 A1 Jun. 26, 2014

(51) Int. Cl.

| | |
|---|---|
| ***A47G 5/00*** | (2006.01) |
| ***E06B 1/36*** | (2006.01) |
| ***E06B 3/964*** | (2006.01) |
| ***E06B 3/968*** | (2006.01) |
| ***E06B 3/972*** | (2006.01) |
| ***E06B 9/52*** | (2006.01) |

(52) U.S. Cl.

CPC ..... *E06B 1/36* (2013.01); *E06B 3/9641* (2013.01); *E06B 3/9681* (2013.01); *E06B 3/972* (2013.01); *E06B 9/52* (2013.01); *E06B 2009/527* (2013.01)

(58) Field of Classification Search

CPC ..... E06B 9/52; E06B 2009/527

USPC ..... 160/371, 378, 381; 52/656.9, 656.1, 52/656.7, 656.5, 656.6, 582.2; 403/205, 403/295; 292/202, 240, 56, 218, 195

See application file for complete search history.

(56) References Cited

U.S. PATENT DOCUMENTS 64,601 A * 5/1867 Verbeck ..... E05B 83/10 292/218
75,996 A * 3/1868 Snarks ..... E05C 3/042 292/202
134,715 A * 1/1873 Warren ..... E05B 17/0025 292/56
160,525 A * 3/1875 Husted ..... E05B 65/0042 292/332
232,270 A * 9/1880 Haug ..... E05B 83/10 292/218
371,933 A * 10/1887 Gray ..... 160/374.1
371,934 A * 10/1887 Gray ..... 160/374.1
412,067 A * 10/1889 Blue ..... E05B 83/10 292/218
855,259 A * 5/1907 Richards ..... E05C 3/046 292/240
1,357,864 A * 11/1920 Harrington ..... E05B 65/0057 27/DIG. 1
1,373,145 A * 3/1921 Pachesa ..... E05D 13/06 292/169
1,398,174 A * 11/1921 Carlson ..... E05F 11/00 292/202
1,592,488 A * 7/1926 Gurisch ..... E05C 3/042 292/202
1,601,687 A * 9/1926 Krayn ..... B61D 25/00 292/226
1,685,316 A * 9/1928 Devereaux ..... E05B 3/06 292/348

(Continued)

*Primary Examiner* — Katherine Mitchell
*Assistant Examiner* — Johnnie A Shablack
(74) *Attorney, Agent, or Firm* — Rathe Lindenbaum LLP

(57) ABSTRACT

A screen frame includes at least two lineal members and a corner brace securing the two lineal members together. A turn piece latch is rotatably secured in an aperture in the corner brace. The turn piece latch includes a latch portion releasably securing the screen frame to a window structure.

19 Claims, 3 Drawing Sheets

(56) References Cited

U.S. PATENT DOCUMENTS 1,700,093 A * 1/1929 Hamm ..... B61D 25/00 292/195
1,701,140 A * 2/1929 Chaffee ..... E05F 11/00 292/40
1,900,936 A * 3/1933 Huttger ..... E05F 11/00 114/203
1,970,677 A * 8/1934 Vogt ..... E06B 9/522 160/105
2,174,800 A 10/1939 Mcdonald
2,301,078 A * 11/1942 Perron ..... E05C 3/041 292/202
2,551,408 A * 5/1951 Amundson ..... E05C 3/041 292/202
2,634,146 A * 4/1953 Johnson ..... E05C 3/042 292/194
2,716,037 A * 8/1955 Skodnek ..... E05D 15/00 292/202
2,776,002 A * 1/1957 Owen Conrad ..... E05D 15/00 160/369
2,900,678 A 8/1959 Curtis
3,142,504 A * 7/1964 Jordan, Sr. ..... E05D 15/00 292/220
3,425,721 A * 2/1969 Agee ..... 403/294
3,429,601 A * 2/1969 Bremers ..... 403/230
3,443,783 A * 5/1969 Fisher Julian V ..... F16B 19/00 248/222.52
3,575,452 A * 4/1971 Blomgren ..... E05C 3/042 292/202
3,606,419 A * 9/1971 Virkler et al. ..... 52/656.9
3,715,531 A * 2/1973 Keeley ..... 200/19.39
3,782,054 A * 1/1974 Goss, Jr. ..... 403/295
3,800,369 A * 4/1974 Nikolits et al. ..... 24/590.1
3,921,261 A * 11/1975 Fisher ..... 24/580.1
4,050,724 A * 9/1977 Nakanishi ..... E05C 3/046 292/241
4,153,284 A * 5/1979 Wright ..... 292/202
4,186,952 A * 2/1980 Glass ..... 292/202
4,391,461 A 7/1983 Deibele
4,493,583 A * 1/1985 Wallace ..... 403/402
4,502,260 A 3/1985 Machler
4,573,721 A 3/1986 Orchard et al.
4,591,307 A * 5/1986 Clive-Smith ..... 410/83
4,651,482 A * 3/1987 Borys ..... 52/172
4,829,685 A * 5/1989 Persson et al. ..... 38/102.5
4,947,922 A * 8/1990 Stobart ..... 160/374.1
4,995,652 A * 2/1991 Mugnolo ..... E05C 3/042 292/202
5,090,835 A * 2/1992 Cox ..... 403/294
5,119,872 A * 6/1992 Engebretson ..... 160/381
5,450,701 A * 9/1995 White ..... 52/656.9
5,473,853 A 12/1995 Guillemet et al.
5,485,705 A * 1/1996 Guillemet ..... 52/656.9
5,630,632 A * 5/1997 Swan ..... 292/240
6,138,741 A * 10/2000 Stobart ..... 160/374.1
6,170,555 B1 * 1/2001 Welfonder ..... 160/381
6,339,891 B1 * 1/2002 Cox ..... 40/785
6,425,210 B1 * 7/2002 Ricci ..... 49/504
6,626,472 B1 * 9/2003 Berg ..... E05B 13/002 292/336.3
6,644,380 B2 * 11/2003 Perich et al. ..... 160/381
6,672,365 B2 * 1/2004 Therrien ..... 160/369
6,746,175 B1 * 6/2004 Gonnerman et al. ..... 403/403
6,813,862 B2 * 11/2004 Perich ..... E05B 65/0876 16/105
6,955,515 B2 * 10/2005 Barina et al. ..... 411/508
7,152,383 B1 * 12/2006 Wilkinson et al. ..... 52/581
7,634,880 B2 * 12/2009 Sironko et al. ..... 52/456
8,307,880 B2 * 11/2012 Ocampo ..... 160/374.1
8,353,253 B2 * 1/2013 Outland et al. ..... 114/203
8,490,545 B2 * 7/2013 Hall et al. ..... 101/127.1
8,528,293 B2 * 9/2013 Sawyers et al. ..... 52/656.9
8,615,970 B2 * 12/2013 Hoberman ..... E04B 1/86 160/187
8,636,437 B2 * 1/2014 Therrien ..... 403/205
8,840,333 B2 * 9/2014 Massey ..... 403/231
8,869,871 B2 * 10/2014 Massey ..... E06B 9/52 160/269
8,887,793 B2 * 11/2014 Massey ..... E06B 3/26 160/369
8,919,826 B2 * 12/2014 Small ..... E05C 1/004 292/175
2001/0034989 A1 * 11/2001 Geiberger et al. ..... 52/287.1
2002/0005261 A1 * 1/2002 Therrien ..... 160/381
2003/0127201 A1 * 7/2003 Perich ..... E06B 3/9647 160/381
2007/0056701 A1 * 3/2007 Brooker et al. ..... 160/381
2007/0175163 A1 * 8/2007 Williams et al. ..... 52/656.1
2009/0003928 A1 * 1/2009 Ohrstrom ..... 403/205
2012/0285637 A1 * 11/2012 Kasuya ..... 160/369
2014/0053390 A1 * 2/2014 Massey ..... 29/525.11
2014/0174021 A1 * 6/2014 Massey ..... 52/656.9

* cited by examiner

SCREEN CORNER ATTACHMENT

CROSS-REFERENCE TO RELATED PATENT APPLICATIONS none

BACKGROUND

The present invention relates generally to the field of window screen corner latch mechanisms to secure a window screen. Screen latches are used to secure a screen to a window frame so that the screen may be installed and removed depending on the season and desired use by an occupant.

SUMMARY OF THE INVENTION

A screen frame includes at least two lineal members and a corner brace securing the two lineal members together. A turn piece latch is rotatably secured in an aperture in the corner brace. The turn piece latch includes a latch portion releasbly securing the screen frame to a window structure.

DETAILED DESCRIPTION OF THE EXAMPLE EMBODIMENTS

Figure 1:
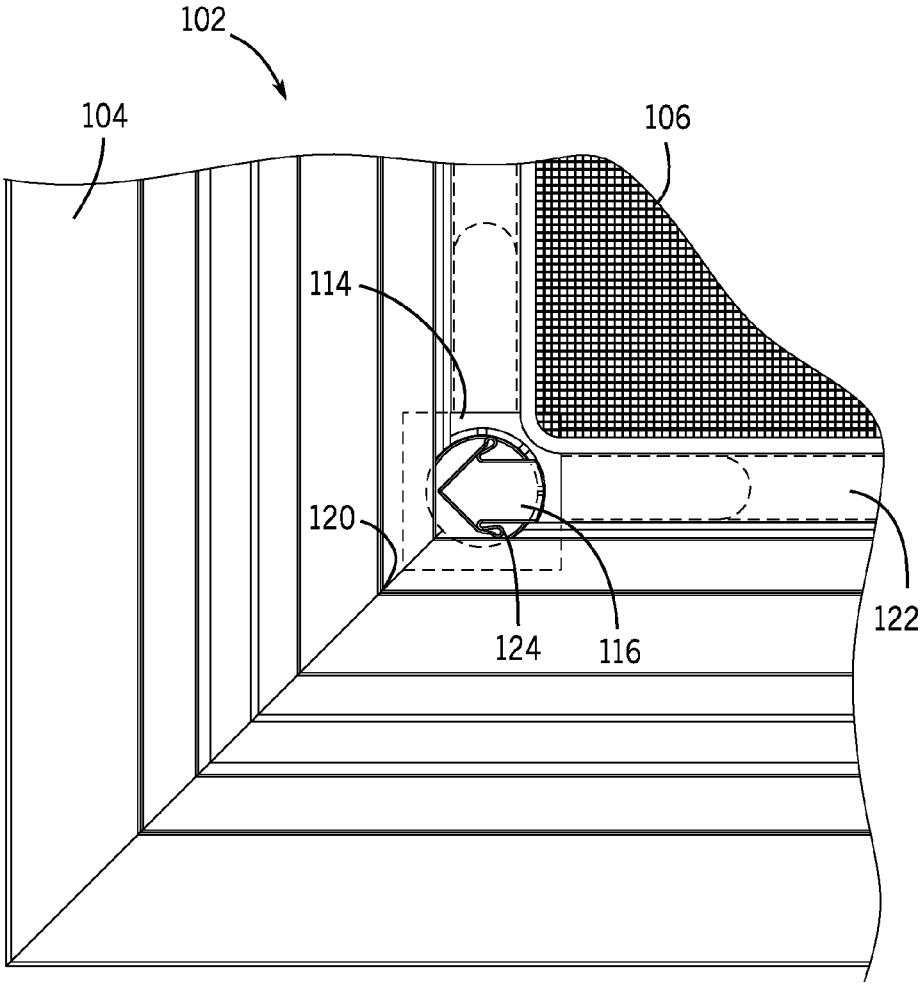
FIG. 1 is a top view of a corner latch assembly.
Figure 6:
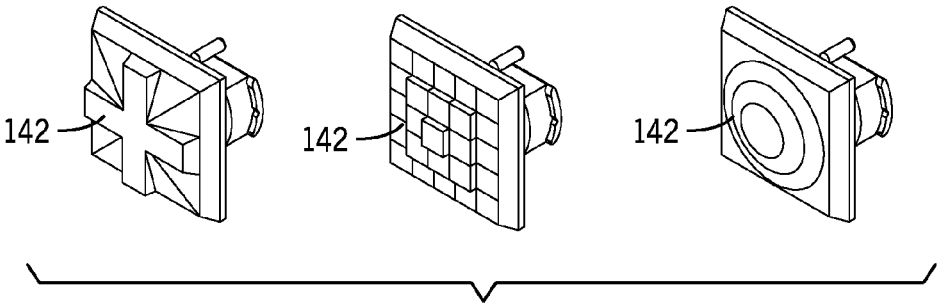
FIG. 6 is an isometric view of various embodiments of cap 142.
Figure 2:
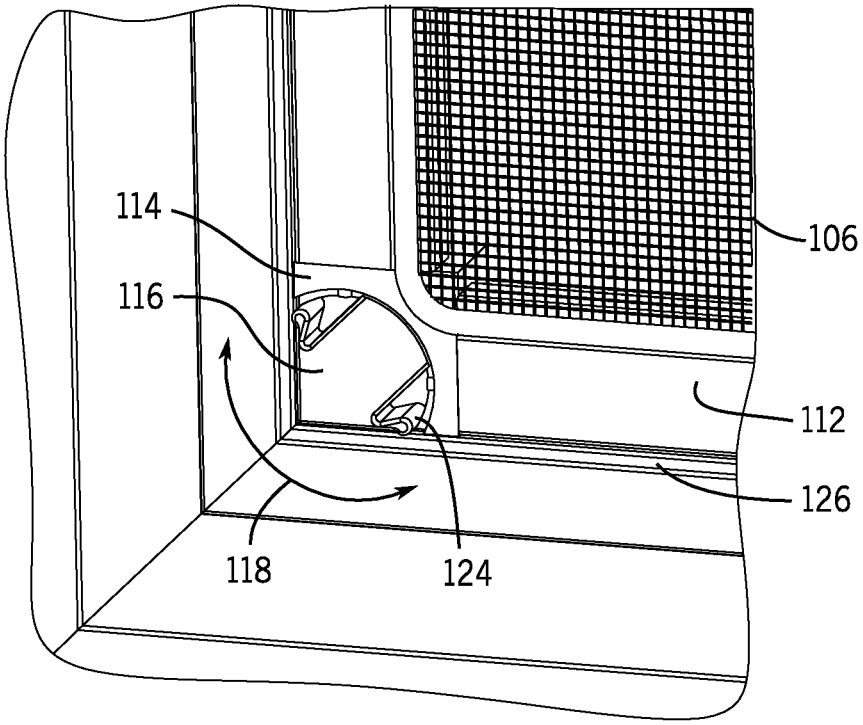
FIG. 2 is a top angle view close-up of the corner latch assembly.
Figure 3:
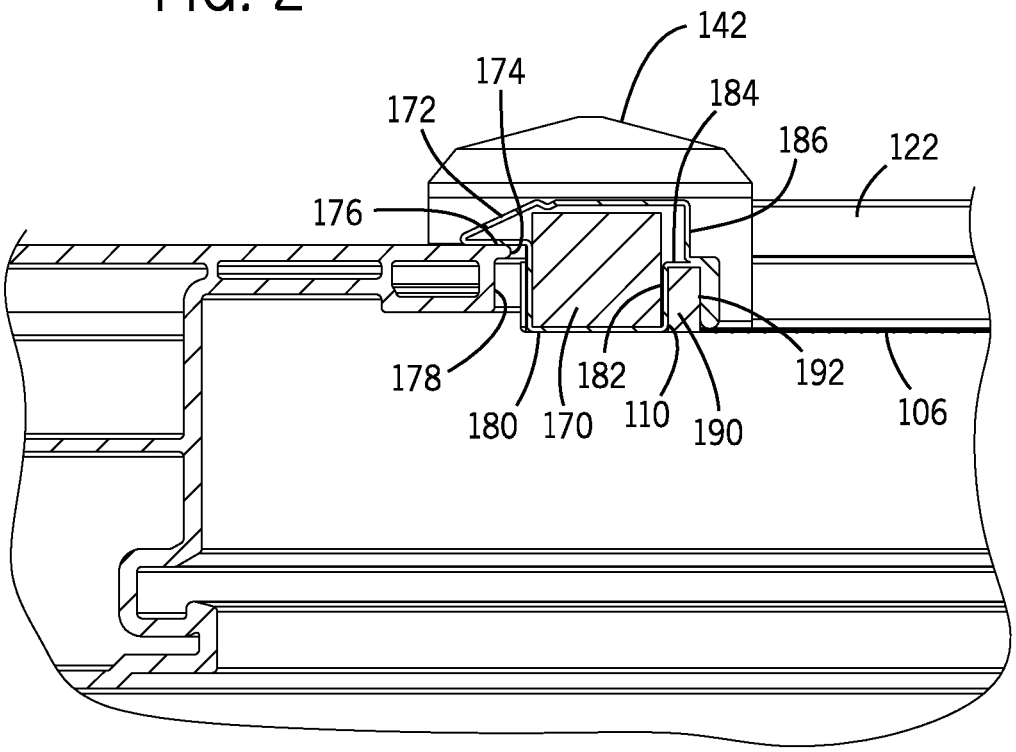
FIG. 3 is a cross-sectional view of the corner latch assembly of FIG. 2 in a disengaged position.

Referring to FIGS. 1, 2 and 3, a corner latch window assembly 100 is configured to removably secure a screen assembly 102 to a door frame or window frame 104 or door frame. Screen assembly 102 comprises a flexible membrane or screen 106 attached to a screen frame 108 with an attachment device or spline 110. Screen frame 108 includes a screen frame member or screen lineal 112. Screen assembly 102 when secured to screen frame 104 separates the inside of a building with the outside of the building, or separates one part of an architectural structure from another part of the architectural structure. At least one corner latch window assembly 100 is coupled to screen lineal 112 to removably secure screen assembly 102 to window frame 104.

Corner latch mechanism 100 may be used to secure a screen to a window or door. Typically, a window or door with a screen is installed in a vertically-oriented, exterior wall of a building structure separating an inside space from an outside space. While corner latch window assembly 100 may be used to secure a screen assembly to different types of windows and doors and in different locations and orientations on the structure, corner latch window assembly 100 will be described relative to a screen assembly secured to a window in an exterior wall of a structure with the screen assembly 102 being secured to the frame from the inside of the structure. The direction "up" or "upward" is used to reference a general vertically-oriented vector direction away from the force of gravity while the term "down" or "downward" is used to reference a general vertically-oriented vector direction toward the force of gravity. The direction "in" or "inward" is used to reference a general horizontally-oriented vector direction toward the inside of the structure. The direction "out" or "outward" is used to reference a general horizontally-oriented vector direction toward the outside of the structure. The term "front" or "inside" is used to describe the surface that a person would see facing the window from the inside of a building structure while the term "rear" or "outside" is used to describe the surface that a person would see facing the window from the outside of a building structure. With respect to screen frame 104, the term "inboard" is used to describe the area inside the form or shape created by screen frame 104, while the term "outboard" is used to describe the area outside the form created by screen frame 104.

Corner latch window assembly 100 includes a bolt or brace 114 and a turn handle 116 that is movably coupled to screen lineal 112 in a rotating motion along a bidirectional arc 118 between an engaged position and a disengaged position with respect to screen frame 104. The term bidirectional arc 118 will include a rotation or twist movement in a clockwise or counterclockwise direction. In one embodiment, a plurality (normally four) of corner latch mechanisms 100 are located in the corners 120 of the screen assembly 102. Referring to FIG. 2, corner latch window assembly 100 may be placed in an unlocked position when turn handle 116 is in the disengaged position from rotation of the bidirectional arc 118, repositioning a contact point 124 when a user rotates each turn handle 116.

Referring to FIG. 3, corner latch window assembly 100 may be rotated back to a locked position by having a contact point 124 move over a lip 126 of window frame 104 to allow corner latch window assembly 100 to be placed in the engaged position. Optional stops 128 may be placed just beyond the perimeter of each turn handle 116. This would allow a user to get a tactile feel when the screen assembly 102 is available for removal as well as locked in place. Also, FIG. 4 shows shoulders 130 that are in place to keep the user from over-rotating the turn handle 116, thereby putting the contact point 124 in an optimal position for holding the screen assembly 102.

Figure 4:
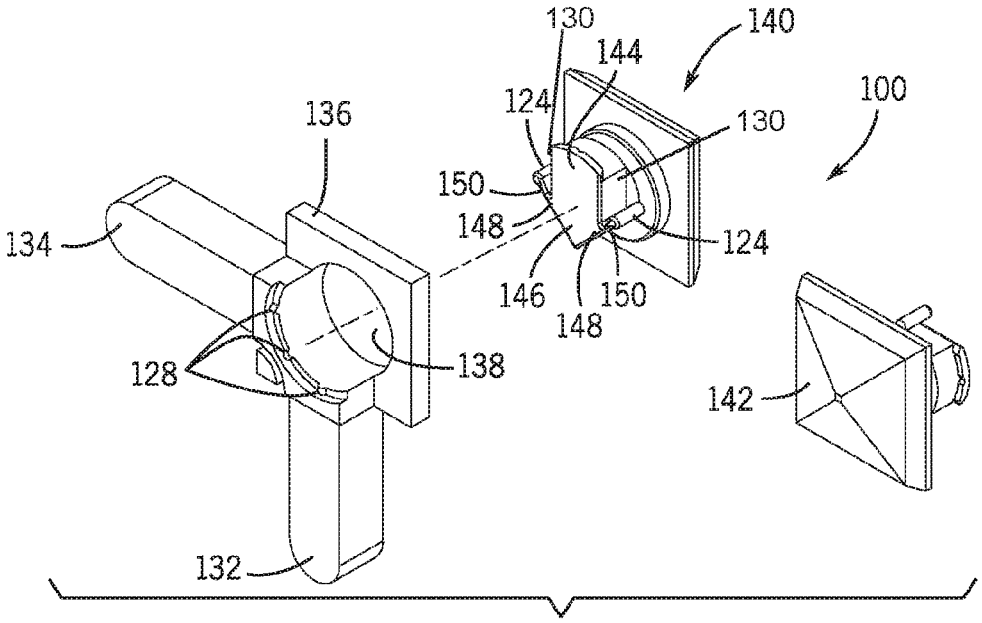
FIG. 4 is an exploded view of a brace and a turn handle.

FIG. 4 shows the brace 114 including a first planar leg 132 and a second planar leg 134 extending from a center portion 136. The two planar legs 132, 134 are designed to fit within a respective channel of adjacent lineals 112. The two planar legs 132, 134 are slightly wider than the screen lineal 112. Screen lineals 112 are fit snugly secure through frictional contact to the two planar legs 132, 134.

The center portion 136 includes an aperture 138 configured to rotatably receive turn handle 116. Aperture 138 may include bushings (not shown) to rotatably hold turn handle 116 within aperture 138.

FIG. 4 shows the turn handle 116 comprising an arrow shape post 140 and a cap 142. In one embodiment the stem portion 144 of the arrow shape post 140 is seamlessly attached to the arrowhead 146. However, the tails 148 of the arrowhead 146 have a spring 150 connected to each side of the tails 148. Connected to the opposite side of spring 150 is a contact point 124. The spring 150 flexes to accommodate tolerance is necessary for manufacturing the screen assembly 102. The contact point 124 does not contact the screen assembly 102 until the user operates the turn handle 116 into the locked position. This keeps the contact point 124 from marring the screen assembly 102.

Corner latch mechanism 100 provides easy operation for removably securing screen assembly 102 to screen frame 104. Screen assembly 102 is secured or attached to screen frame 104 from inside the structure with turn handle 116 also facing inside the structure and facing a user.

As will be described in detail below, turn handle 116 of corner latch window assembly 100 responds to the force of the screen being pressed into screen frame 104 by rotating along a bidirectional arc 118 clockwise or counterclockwise within screen lineal 112 as contact point 124 engages screen frame 104. The contact point 124 then moves outwardly once brace 114 clears screen frame 104. Turn handle 116 ceases rotation when a shoulder 130 makes contact with the screen frame 104. In this position the turn handle 116 is in the engaged position, correlating to completion of attachment of screen assembly 102 to screen frame 104. To detach screen assembly 102 from frame 104, the user rotates turn handle 116 clockwise or counterclockwise to the disengaged position. This causes the contact point 124 to cross the lip 126 of window frame 104 and causes the arrowhead 146 as shown in FIG. 2 to be removed out of its corner 154 as shown in FIG. 1. As a result, corner latch window assembly 100 is pivoted to the unlocked position. The user ceases manipulation of turn handle 116 and removes screen assembly 102 from screen frame 104. Corner latch mechanism 100 will remain stationary until the user rotates turn handle 116 in the opposite direction.

Referring to FIG. 1, flexible membrane or screen 106 provides a separation between two areas, including between two rooms or areas within a building structure and between the inside of a building structure and the outside of the building structure. Screen 106 may be constructed of a material with characteristics including, but not limited to, the following: permeable, impermeable, metallic, plastic, fabric, opaque, translucent, transparent, woven. Screen 106 may also include decorative elements including, but not limited to, designs and artwork. In one embodiment, screen 106 may be of a permeable material and located in an exterior building wall, thereby allowing air circulation between the inside and outside of the building. In another embodiment, screen 106 may be of a permeable material and located in an interior building wall, thereby allowing air circulation between two rooms within a building. In yet another embodiment, screen 106 may be of a translucent material with an included artistic design, thereby providing visual and aesthetically-pleasing privacy between two rooms within a building.

Screen frame 108 is a substantially rigid component or structure, including at least one screen lineal 112, configured to receive and support screen 106 and to interface with screen frame 104. Screen frame 108 has a shape corresponding to the shape of screen frame 104 and a configuration to accept screen 106 and spline 110 such that screen 106 spans the area contained within the shape or inboard area of screen frame 108. In one embodiment, screen frame 108 may include four lineals, creating a rectangular or square shape. In another embodiment, screen frame 108 may include three lineals, creating a triangular shape. In other embodiments, screen frame 108 may include other quantities of screen lineal 112, creating other shapes, including, but not limited to, pentagon, hexagon and octagon.

Screen attachment or spline 110 removably secures screen 106 to screen frame 108. Spline 110 comprises a component of compressible material of a substantially consistent cross-sectional area and of a length sufficient to circumnavigate the perimeter of the shape of screen frame 108 proximate the inboard area. Spline 110 retains screen 106 to screen frame 108 by compressive fitment of spline 110 into an area of screen frame 108 with a cross-sectional area that is smaller than the cross-section of spline 110. Spline 110 and screen 106 are removable from frame 108 substantially without damage to spline 110, screen 106 or frame 108.

Figure 5:
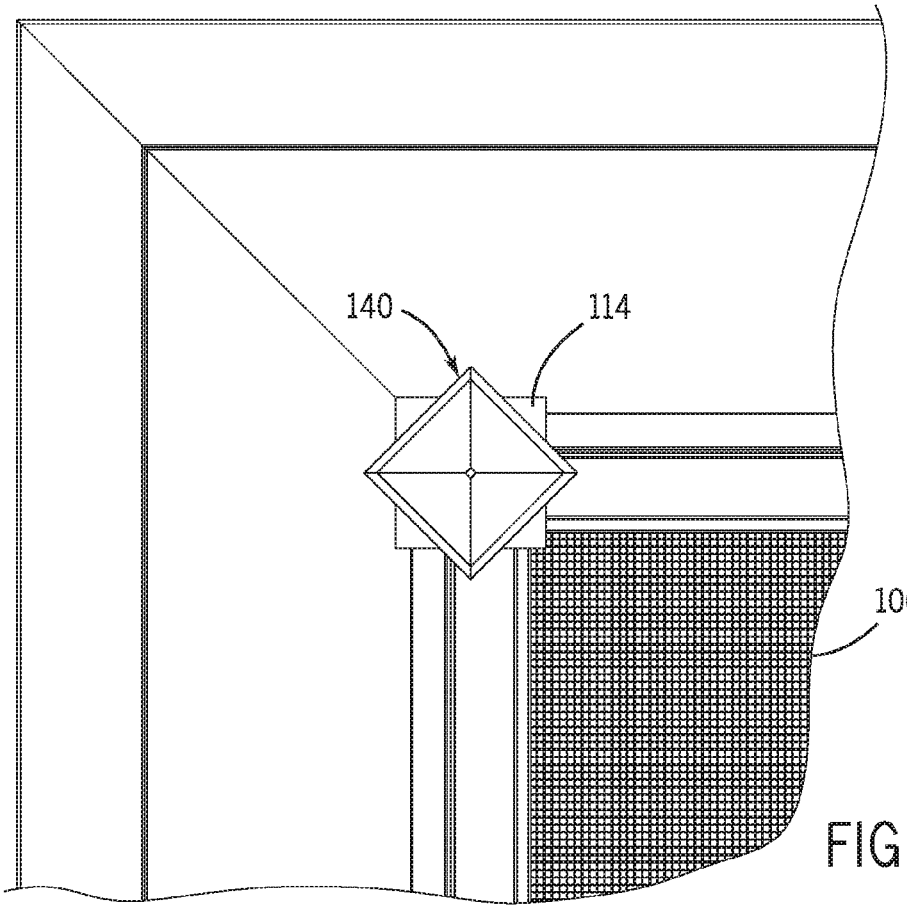
FIG. 5 is a top view of the corner latch assembly where the turn handle has a cap that is positioned in the disengaged position.

Referring to FIGS. 1, 3 and 5, screen member or lineal portion or screen lineal 112 is a substantially rigid component of screen frame 108 that engages with window frame 104. FIG. 3 shows each screen lineal 122 forms a channel 170 and an upside down screen channel 190. From an exit/entrance or side view of the channel 170. The channel 170 may be open at both ends, closed at either end or closed at both ends. The channel 170 comprises a flat top surface 172.

The flat top surface 172 is connected to a roof surface 174. The handling of the roof surface 174 bends towards the plane created by the screen frame 108. The angle formed between the flat top surface 172 and the roof surface 174 is approximately 150°. The roof surface 174 is connected to a lip surface 176. The lip surface 176 is essentially parallel to the flat top surface 172 and the screen frame 108. The angle formed by the lip surface 176 and the angled top surface is approximately 30°.

Lip surface 176 is connected to a first vertical wall 178. The angle formed between the lip surface 176 of the first vertical wall 178 is 90°. A channel floor 180 is connected to the first vertical wall 178. The channel floor 180 is nearly parallel to the plane of the screen frame 108. In fact, the channel floor 180 is nearly in the plane created by screen frame 108. The angled created by the channel floor 180 and the first vertical wall 178 is approximately 90°. The channel floor 180 is connected to the second vertical wall 182. The angle created by the channel floor 180 and the second vertical wall 182 is approximately 90°. The second vertical wall 182 is connected to an elevated floor wall 184. The elevated floor wall 184 is parallel to the channel floor 180, approximately 2/2 the distance of the height of the channel 170. The elevated floor wall 184 bends 90° away from the channel floor 180. The elevated floor wall 184 is connected to a third vertical wall 186. The third vertical wall 186 bends 90° up towards the flat top surface 172. The third vertical wall 186 and the flat top surface 172 are connected at approximately 90°.

The upside down screen channel 190 contained within the screen lineal 122, is an upside down rectangle-U-shaped. The upside down screen channel 190 comprises the second vertical wall 182 connected to a channel top surface 184 at approximately 90°. The channel top surface 184 is connected to a third vertical wall 192 at approximately 90°. Within the screen channel 190, there is a rectangular block or screen spline 110. The screen spline 110 is approximately the height the second vertical wall 182 and the third vertical wall 192.

To remove a screen assembly 102 from a window frame 104, a user rotates the turn handle 116 in either direction. If the optional stops 128 are in place, the user will stop rotation when the user feels a stop 128 during rotation. The repositioning of the arrow platform 140 relaxes the corresponding spline 110, thereby, releasing the screen assembly 102. The screen assembly 102 is now ready for removal.

To attach screen assembly 102 to window frame 104, a user positions screen assembly 102 into alignment with the corresponding opening in window frame 104 and exerts a force on screen lineal members 112 toward screen frame 104 in the outside direction. The user rotates the turn handle 116 automatically adjusts as the spline 110 engages screen frame 104.

It is important to note that the construction mechanism as described herein is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A screen frame including:

at least two lineal members, including a first lineal member and a second lineal member;

a corner brace securing the first lineal member and the second lineal member together, the corner brace including a center portion having an outer periphery extending beyond an outermost periphery of the first lineal member and the outermost periphery of the second lineal member and configured to contact a window structure;

a screen secured to the first lineal member and second lineal member, the screen defining a plane;

a turn piece latch rotatably secured in an aperture of the center portion of the corner brace; and wherein the turn piece latch includes a latch portion releasably securing the screen frame to the window structure, the latch portion being movable from a first position in which the screen frame is secured to the window structure to a second position in which the screen frame is released from the window structure, a cap being operatively connected to the latch portion, wherein a portion of the cap extends beyond a portion of the outer periphery of the corner brace in a direction parallel to the plane when the latch portion is in the second position and wherein the cap is positioned completely within the area defined by the outer periphery of the corner brace in the first position.

2. The screen frame of claim 1, wherein, the latch portion includes at least one contact; and wherein the cap having an outer periphery the same size as the outer periphery of the center portion of the corner brace.

3. The screen frame of claim 2, wherein, the turn piece latch includes at least one spring portion releasably latching the screen frame to the window structure at a first location.

4. The screen frame of claim 3, wherein, a point of the turn piece latch releasably latches the screen frame to the window structure at a second location.

5. The screen frame of claim 4, wherein, a contact point of the at least one spring portion overlays a lip of a window structure when the latch portion is in a locked position.

6. The screen frame of claim 1, wherein, the turn piece latch includes an overturn shoulder.

7. The screen frame of claim 1, wherein, the corner brace connects to the first lineal member at a corner of the screen frame.

8. The screen frame of claim 1 wherein, the center portion of the corner brace is wider than the first lineal member.

9. The screen frame of claim 1 wherein, the corner brace includes a bushing area to hold the turn piece latch.

10. The screen frame of claim 1, wherein the corner brace includes a recess.

11. The screen frame of claim 1, wherein the turn piece latch includes at least one position stop.

12. The screen frame of claim 1, wherein, the turn piece latch is bidirectional.

13. The screen frame of claim 1, wherein the lip is approximately ⅛ inch high.

14. The screen frame—of claim 1 wherein, the turn piece latch includes the cap operatively connected to the latch portion.

15. The screen frame of claim 14 wherein, a three-dimensional shape of the cap is selected from the group consisting of a three-dimensional cross, a pyramid, a three-dimensional checkerboard and a half-dome.

16. The screen frame of claim 1, wherein the brace includes at least one stop to releasably receive the spring biased contact point.

17. The screen frame claim 16, wherein,the latch is arrow shaped, wherein the tip of the arrow releasably engages a portion of a window frame.

18. The screen frame of claim 1, wherein a base includes bushings that rotatably hold the latch.

19. A method for attaching and removing the screen frame of claim 1 from a window frame comprising:

providing a screen frame having at least a first lineal and a second lineal member secured together with a corner brace having a center portion extending outside of and between the first and second lineal members;

providing a latch in an aperture in the center portion with a a turn-piece latch;

placing the screen frame within an opening of a window frame;

rotating the latch within the corner brace to an engaged position to secure the window frame;

rotating the latch within the corner brace to a disengaged position to release the latch from the window frame;

removing the window screen from the window frame.

* * * * *